US006229290B1

(12) United States Patent
Nguyen et al.

(10) Patent No.: US 6,229,290 B1
(45) Date of Patent: May 8, 2001

(54) VOLTAGE REGULATING CIRCUIT WITH A CLAMP UP CIRCUIT AND A CLAMP DOWN CIRCUIT OPERATING IN TANDEM

(75) Inventors: Hung Nguyen, Fremont; Guy Yuen, San Jose, both of CA (US)

(73) Assignee: Silicon Storage Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/574,387

(22) Filed: May 19, 2000

(51) Int. Cl.[7] ..... G05F 1/40; G05F 1/10

(52) U.S. Cl. ..... 323/268; 323/266; 327/538

(58) Field of Search ..... 323/268, 266, 323/271, 288, 312, 313, 315; 363/89; 327/530, 538, 537, 535, 539, 540

(56) References Cited

U.S. PATENT DOCUMENTS 4,578,630 * 3/1986 Grosch ..... 323/271
5,264,782 * 11/1993 Newton ..... 323/288
5,367,247 * 11/1994 Blocher et al. ..... 323/222
5,631,599 * 5/1997 Bacrania et al. ..... 327/542
5,818,271 * 10/1998 Stanojevic ..... 327/143
5,818,708 * 10/1998 Wong ..... 363/89

* cited by examiner

*Primary Examiner*—Rajnikant B. Patel
(74) *Attorney, Agent, or Firm*—Gray Cary Ware & Freidenrich LLP

(57) ABSTRACT

A voltage regulating circuit has a clamp up circuit and a clamp down circuit operating in tandem. The clamp down circuit receives the unregulated voltage and an activation signal and in response thereto generates a first output signal at an output node in the event the unregulated voltage exceeds the first output signal. The clamp up circuit receives the unregulated voltage and an inverse of the activation signal and in response thereto generates a second output voltage at an output node in the event the unregulated voltage is below the second output voltage. The output node of the clamp down circuit is connected to the output node of the clamp up circuit. Thus, the output voltage is regulated to be between the first output voltage and the second output voltage.

10 Claims, 4 Drawing Sheets

VOLTAGE REGULATING CIRCUIT WITH A CLAMP UP CIRCUIT AND A CLAMP DOWN CIRCUIT OPERATING IN TANDEM

TECHNICAL FIELD

The present invention relates to a voltage regulating circuit for use in an integrated circuit for receiving an externally supplied voltage and for providing a regulated voltage supplied to the various components of the integrated circuit. More particularly, the present invention relates to a voltage regulating circuit having a voltage clamp up circuit and a voltage clamp down circuit operating in tandem.

BACKGROUND OF THE INVENTION

A constant voltage circuit with very low impedance is desired in many applications in integrated circuit design. This requirement may include a fast response time and a simple implementation. Thus, an externally supplied voltage source can be regulated to provide an internal power supply for low power, low voltage application. Heretofore, although voltage regulating circuits are well known in the art, they have not satisfied the criteria of supplying low power, with fast response time and simple implementation for use in an integrated circuit.

SUMMARY OF THE INVENTION

A voltage regulating circuit receives an unregulated voltage and an activation signal and in response thereto provides a regulated voltage. The voltage regulating circuit has a voltage clamp down circuit operating in tandem with a clamp up circuit. The voltage clamp down circuit receives the unregulated voltage and the activation signal and in response thereto generates a first output voltage at an output node in the event the unregulated voltage exceeds the first output voltage. The voltage clamp up circuit receives the unregulated voltage and an inverse of the activation signal and in response thereto generates a second output voltage at an output node in the event the unregulated voltage is below the second output voltage. The output node of the voltage clamp down circuit is connected to the output node of the clamp up circuit.

DETAILED DESCRIPTION OF THE DRAWINGS

Figure 1:
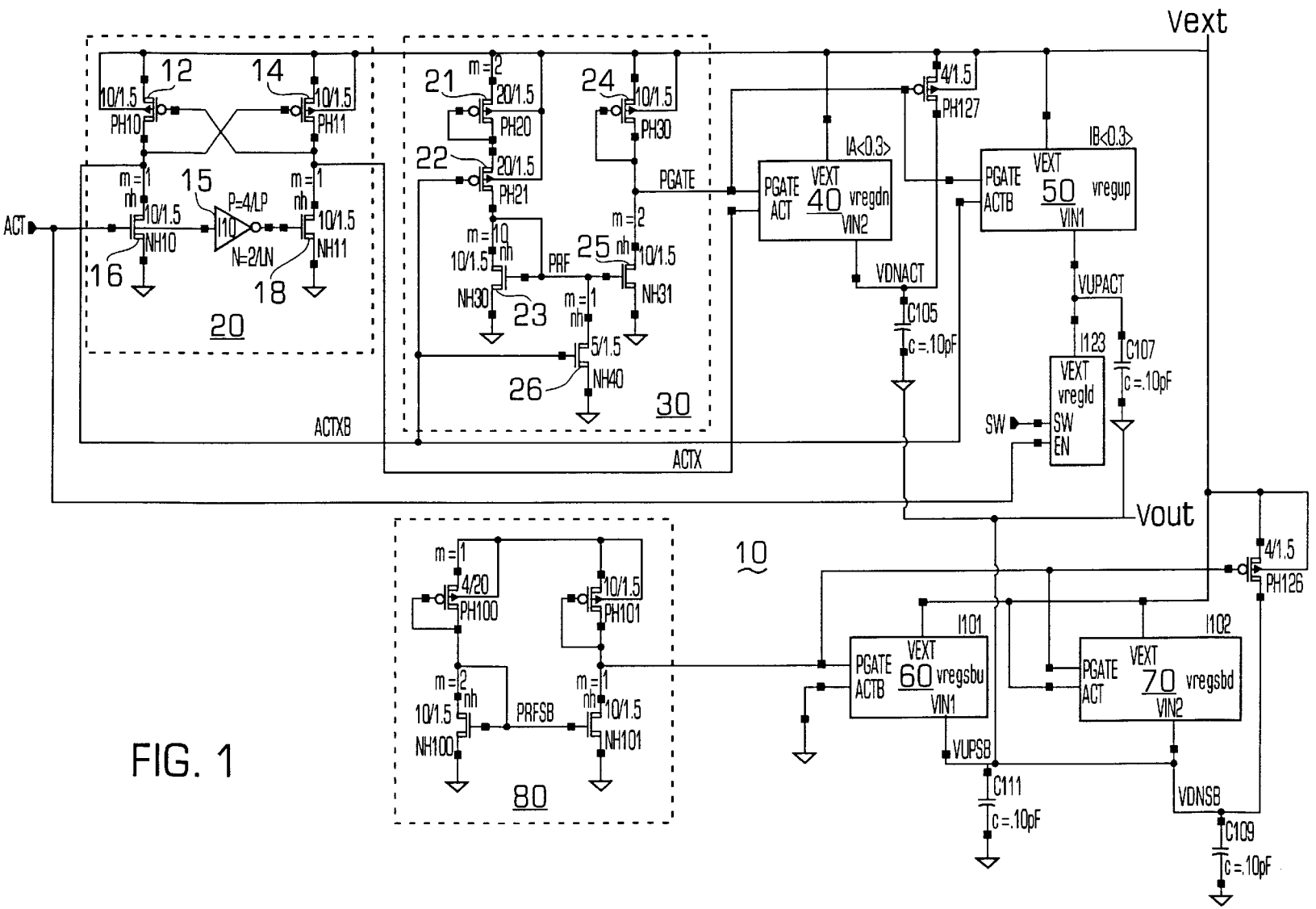
FIG. 1 is a schematic circuit diagram of the voltage regulating circuit of the present invention.

Referring to FIG. 1 there is shown a schematic circuit diagram of a voltage regulating circuit 10 of the present invention. The circuit 10 receives an activation signal, ACT. The activation signal ACT is a logic input signal. When ACT is low, it places the circuit 10 in a standby state. When ACT is high, it places the circuit 10 in an active state.

The ACT signal is latched into a latch 20, which is well known in the art. The latch 20 comprises two cross-coupled PMOS transistors 12 and 14 whose source are connected to the external unregulated voltage Vext. (As used herein, those having ordinary skill in the art will recognize the term source and drain are interchangeable for MOS, symmetrical transistors.) The latch 20 also comprises two NMOS transistors 16 and 18. NMOS transistor 16 receives the signal ACT at its gate. Finally, an inverter 15 also receives the activation signal ACT and generates an inverse signal thereof, which is supplied to the gate of the NMOS transistor 18. The outputs of the latch 20 are the signals ACTX and its inverse ACTXB. These are supplied to a first clamp down circuit 40 and a first clamp up circuit 50 respectively, which will be described in greater detail hereinafter. The latch 20 is a level shifter which generates ACTX and ACTXB referenced to the external power supply Vext.

The ACTXB signal, one of the outputs of the latch 20, is also supplied to a first current mirror circuit 30. The first current mirror circuit 30 comprises a first PMOS transistor 21 connected in series with a second PMOS transistor 22. The first PMOS transistor 21 has its source connected to Vext. The drain of the first PMOS transistor 21 is connected to its gate and to the source of the second PMOS transistor 22. The substrate of the first and second PMOS transistors 21 and 22 are also connected to Vext. The gate of the second PMOS transistor 22 is connected to the signal ACTXB from the latch 20. The drain of the second PMOS transistor 22 is connected to the source of a first NMOS transistor 23 and to the gate thereof. The drain of the first NMOS transistor 23 is connected to ground.

A second current path for the first current mirror circuit 30 comprises a third PMOS transistor 24 whose substrate and source are connected to Vext. The gate of the third PMOS transistor 24 is connected to its drain. The drain of the third PMOS transistor 24 supplies a current signal PGATE. The drain of the third PMOS transistor 24 is also connected to the source of a second NMOS transistor 25. The drain of the second NMOS transistor 25 is connected to ground. Finally, the gates of the first and second NMOS transistors 23 and 25 are connected to the source of the third NMOS transistor 26. The drain of the third NMOS transistor 26 is connected to ground. The gate of the third NMOS transistor also receives the activation signal ACTXB from the latch 20.

Figure 2:
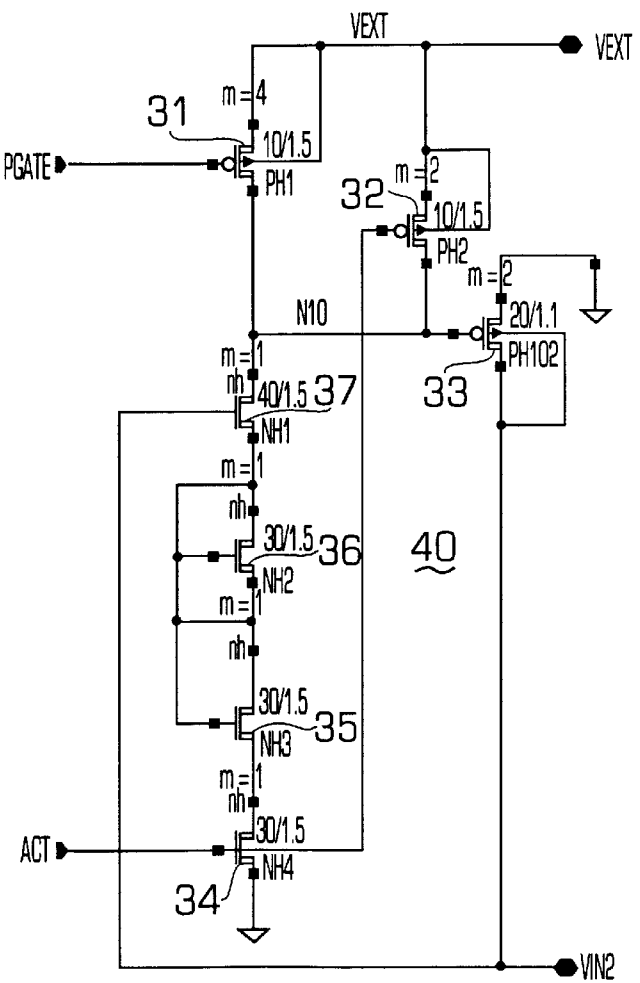
FIG. 2 is a detailed schematic circuit diagram of the clamp down circuit portion of the voltage regulating circuit shown in FIG. 1.

The signal ACTX from the latch 20 and the current signal PGATE from the first current mirror 30 and the external voltage Vext are supplied to the first clamp down circuit 40, which is shown in greater detail in FIG. 2. The activation signal ACTXB from the latch 20, and the current signal PGATE and the external voltage Vext are supplied to a first clamp up circuit 50, which is shown in greater detail in FIG. 3. The output of the first clamp down circuit 40, designated as VIN2 and the output of the first clamp up circuit 50, designated as VIN1 are connected together. In the preferred embodiment, for the reasons discussed hereinafter, the first clamp down circuit 40 comprises a plurality of first clamp down circuits 40 connected in parallel so that the plurality of first clamp down circuits 40 can generate a strong current. Similarly, in the preferred embodiment, the first clamp up circuit 50 also comprises a plurality of first clamp up circuits 50 connected in parallel so that the plurality of first clamp up circuits 50 can generate a strong current.

The first clamp down circuit 40 and the first clamp up circuit 50 are activated when the ACT signal is high, or during the active state. When the ACT signal is low, the first clamp down circuit 40 and the first clamp up circuit 50 are inactive.

The voltage regulating circuit 10 also comprises a second current mirror circuit 80, a second clamp down circuit 70 and a second clamp up circuit 60. As will be shown hereinafter, the second clamp down circuit 70 and the second clamp up circuit 60 are very similar to the first clamp down circuit 40 and the first clamp up circuit 50, respectively. The second clamp down circuit 70 has an input for receiving a current signal from the second current mirror circuit 80 at its input PGATE. In addition, the second clamp down circuit 70 has an input for receiving the external power supply Vext. Finally, the second clamp down circuit 70 has an input node ACT connected to the external power supply Vext. The second clamp up circuit 60 has an input for receiving a current signal from the second current mirror circuit 80 at its input PGATE. In addition, the second clamp up circuit 60 has an input for receiving the external power supply Vext. Finally, the second clamp up circuit 60 has an input node ACTB connected to ground. Each of the second clamp down circuit 70 and second clamp up circuit 60 has an out put Vin2 and Vin1, respectively which are connected together and to the outputs Vin1 and Vin2 of the first clamp up circuit 50 and first clamp down circuit 40, respectively, and forms the output Vout.

Referring to FIG. 2 there is shown in greater detail the first clamp down circuit 40. As previously discussed, the first clamp down circuit 40 receives the current signal PGATE from the first current mirror circuit 30, the activation signal ACT from the latch 20, the external unregulated voltage Vext and provides a regulated output voltage on output node VIN2. The first clamp down circuit 40 comprises a first PMOS transistor 31 whose gate receives the current signal PGATE. The first PMOS transistor 31 mirrors the PMOS transistor 24 of the first current mirror circuit 30 but is different in size therefrom. The source and the substrate of the first PMOS transistor 31 are connected together to receive the external voltage Vext. The first clamp down circuit 40 also comprises a second PMOS transistor 32 whose gate receives the activation signal ACT. The substrate and the source of the second PMOS transistor 32 are connected to receive the external voltage Vext. A third PMOS transistor 33 has a source which is connected to ground. The gate of the third PMOS transistor 33 is connected to the drain of the first and second PMOS transistors 31 and 32 respectively. The substrate and the drain of the third PMOS transistor 33 are connected together and to the output node VIN2. The activation signal ACT is also supplied to the gate of a first NMOS transistor 34, whose drain is connected to ground. The source of the first NMOS transistor 34 is connected in series to a plurality of other NMOS transistors. In particular, the source of the first NMOS transistor 34 is connected to the drain of the second NMOS transistor 35 whose source is connected to the drain of the third NMOS transistor 36. The gate of the second NMOS transistor 35 is connected to its source and to the gate of the third NMOS transistor 36 and to the source of the third NMOS transistor 36. The source of the third NMOS transistor 36 is connected to the drain of a fourth NMOS transistor 37 whose gate is connected to the output node VIN2 and whose source is connected to the gate of the third PMOS transistor 33.

Figure 3:
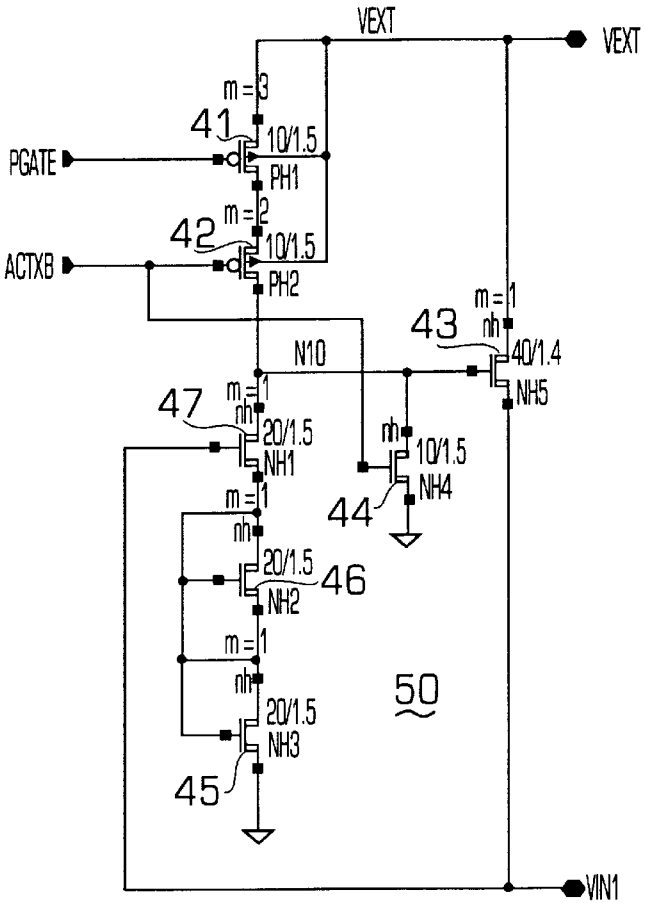
FIG. 3 is a detailed schematic circuit diagram of the clamp up circuit portion of the voltage regulating circuit shown in FIG. 1.

Referring to FIG. 3 there is shown a detailed circuit diagram of the first clamp up circuit 50. The first clamp up circuit 50 comprises a first PMOS transistor 41 whose gate receives the current signal PGATE from the first current mirror circuit 30. The first PMOS transistor 41 mirrors the PMOS transistor 24 of the first current mirror circuit 30 but is different in size therefrom. The substrate and the source of the first PMOS transistor 41 are connected to the external voltage Vext. A second PMOS transistor 42 has its substrate also connected to the substrate of the first PMOS transistor 41 and to the external voltage Vext. The source of the second PMOS transistor 42 is connected to the drain of the first PMOS transistor 41. The gate of the second PMOS transistor 42 is connected to receive the activation signal ACTXB from the latch 20. A first NMOS transistor 43 has its source connected to the external voltage Vext. The gate of the first NMOS transistor 43 is connected to the drain of the second PMOS 42. The drain of the first NMOS transistor 43 is connected to the output node VIN1. A second NMOS transistor 44 has its source connected to the gate of the first NMOS transistor 43. The gate of the second NMOS transistor 44 is connected to receive the inverse activation signal ACTXB from the latch 20. The drain of the second NMOS transistor 44 is connected to ground. A second NMOS transistor 44 has its source connected to the gate of the first NMOS transistor 43. The gate of the second NMOS transistor 44 is connected to receive the inverse activation signal ACTXB from the latch 20. The source of the second NMOS transistor 44 is connected to ground. A chain of third, fourth and fifth NMOS transistors 45, 46 and 47 respectively are connected in series. The third NMOS transistor 45 has a drain connected to ground and its gate connected to its source. The source of the third NMOS transistor is connected to the drain of the fourth NMOS transistor 46. The gate of the fourth NMOS transistor 46 is connected to the gate of the third NMOS transistor 45 and to its source. The source of the fourth NMOS transistor 46 is connected to the drain of the fifth NMOS transistor 47. The source of the fifth NMOS transistor 47 is connected to the gate of the first NMOS transistor 43. The gate of the fifth NMOS transistor 47 is connected to the output node VIN1.

The outputs from the first clamp down circuit 40 and the first clamp up circuits 50 are filtered through capacitors and are then connected together to supply the regulated voltage VOUT.

Figure 4:
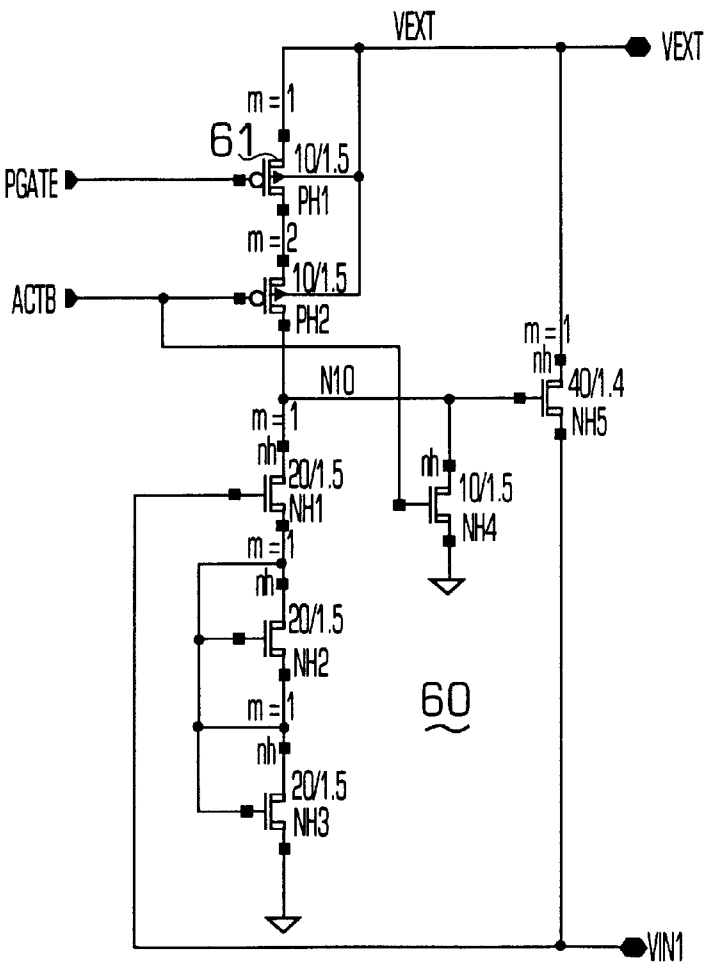
FIG. 4 is a detailed circuit diagram of another portion of the voltage regulating circuit shown in FIG. 1.

Referring to FIG. 4 there is shown a detailed circuit diagram of the second clamp up circuit 60. The second clamp up circuit 60 is identical to the first clamp up circuit 50, except for the size of the PMOS transistor 61, corresponding to the first PMOS transistor 41 (the collective first PMOS transistor 41) of the first clamp up circuit 50, whose gate receives the current signal PGATE from the first current mirror circuit 30. The PMOS transistor 61 of the second clamp up circuit 60 also has a gate which receives the current signal PGATE from the second current mirror circuit 80.

Figure 5:
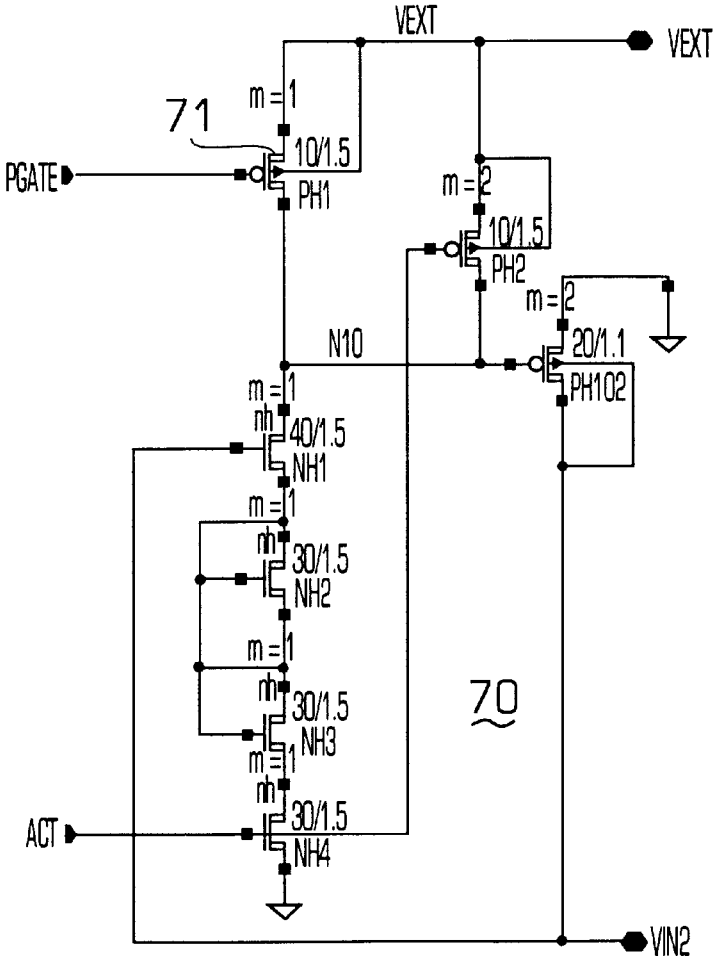
FIG. 5 is a detailed circuit diagram of yet another portion of the voltage regulating circuit shown in FIG. 1.

Referring to FIG. 5 there is shown a detailed circuit diagram of the second clamp down circuit 70. The second clamp down circuit 70 is identical to the first clamp down circuit 40, except for the size of the PMOS transistor 71, corresponding to the first PMOS transistor 31 (the collective first PMOS transistor 41) of the first clamp down circuit 40, whose gate receives the current signal PGATE from the first current mirror circuit 30. The PMOS transistor 71 of the second clamp down circuit 70 also has a gate which receives the current signal PGATE from the second current mirror circuit 80.

Figure 6:
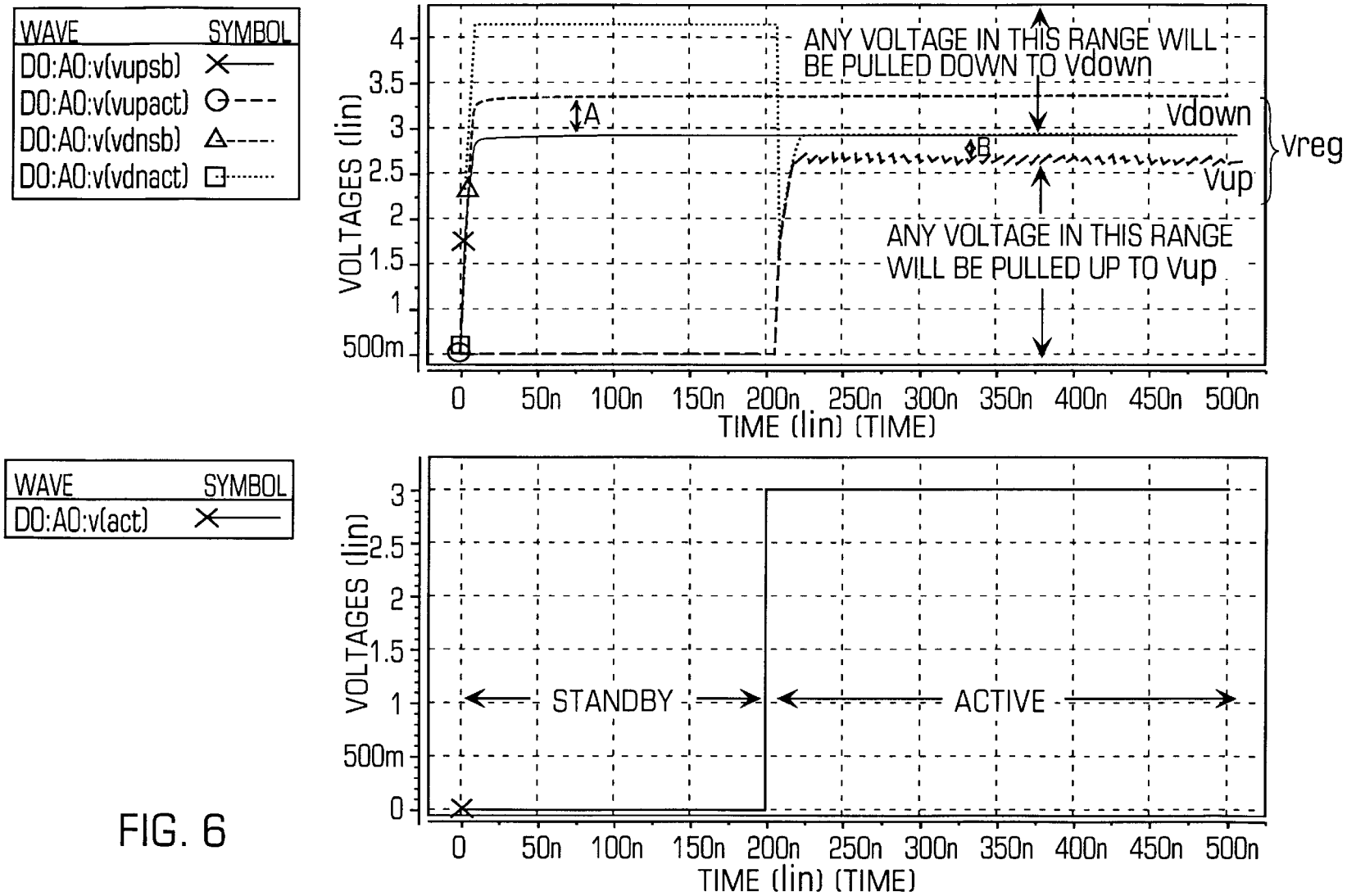
FIG. 6 is a graph showing voltage and time at the output node of the voltage regulating circuit of the present invention.

The operation of the voltage regulating circuit 10 of the present invention can best be understood by referring to FIG. 6. If ACT is low, or the circuit 10 is in standby condition, then only the second clamp up circuit 60 or the second clamp down circuit 70 is activated. In that event, the second current mirror circuit 80 provides a very weak current to either the second clamp up circuit 60 or the second clamp down circuit 70. During standby, if Vext is higher than the highest voltage in the range A, then the second clamp down circuit 70 will turn on to bring the out put voltage Vout to the highest level of the voltage range A. If Vext is lower than lowest voltage in the range A, then the second clamp up circuit 60 will turn on to bring the out put voltage Vout to the lowest voltage level in the range B. If the voltage Vext is in the voltage range A, then neither second clamp up circuit 60 nor second clamp down circuit 70 is on and no power is consumed at all. Since one does not normally expect a strong current to be consumed during the standby state, the second clamp up circuit 60 and the second clamp down circuit 70 can be made weak, and slow to respond to bring the voltage down (as in the case of the second pull down circuit 70 being active) or to bring the voltage up (as in the case of the second pull up circuit 60 being active) to save power.

Although the second clamp up circuit 60 or the second clamp down circuit 70 are activate at all times, when the circuit 10 is in the active state, the second clamp up circuit 60 or the second clamp down circuit 70 do not provide sufficient current for the regulated Vout, nor do they provide a rapid response to bring Vout into a regulated range. The purpose of the second clamp up circuit 60 and the second clamp down circuit 70 is to "pre-charge and hold" the Vout voltage to a voltage level of the clamped level during active mode. Thus, the second clamp up circuit 60 and the second clamp down circuit 70 have a very low standby current. The node designated Pgate for the second clamp up circuit 60 and the second clamp down circuit 70 is connected to the second current mirror circuit 80 for the source of current.

When ACT is high, or the circuit 10 is in active condition, then the first clamp up circuit 50 or the first clamp down circuit 40 will also be activated. In that event, the first current mirror circuit 30 provides a current either to the first clamp up circuit 50 or the first clamp down circuit 40. The current from the first current mirror circuit 30 is a much stronger current than the current from the second current mirror circuit 80.

In the active state, if Vext is higher than the highest voltage in the range B, then the first clamp down circuit 40 will turn on to bring the out put voltage Vout to the highest level in the voltage range B. If Vext is lower than the lowest voltage in the range B, then the first clamp up circuit 50 will turn on to bring the out put voltage Vout to the lowest voltage in the range of B. If the voltage Vext is in the voltage range B, then neither first clamp up circuit 50 nor first clamp down circuit 40 is on and no power is consumed at all. Thus, by making the voltage range B small, the output voltage Vout can be regulated to be in a narrow voltage range.

The first clamp down circuit 40 operates by the first PMOS transistor 31 turning on with a strong bias to quickly switch the gate of the third PMOS transistor 33. Similarly, the first clamp up circuit 50 operates by the first PMOS transistor 41 turning on with a strong bias to quickly switch the gate of the first NMOS transistor 43. However, by using a plurality of first clamp down circuits 40 connected in parallel, (in the preferred embodiment 4—shown as IA<0:3> in FIG. 1) and a plurality of first clamp up circuits 50, also connected in parallel, (also in the preferred embodiment 4—shown as IB<0:3> in FIG. 1) respectively, instead of one giant PMOS transistor 33 or NMOS transistor 43, the response time is much faster, with the ability also to handle a large amount of current flow. Instead of a plurality of first clamp down circuits 40 or a plurality of first clamp up circuits 50, a single first clamp down circuit 40 with a large PMOS transistor 33 or a single clamp up circuit 50 with a large NMOS transistor 43, were used, the response time would be slower to Vout.

Finally, it should be noted that because current from the same current source (first current mirror circuit 30) is applied to both first clamp down circuits 40 and first clamp up circuits 50, and current from the same current source (second current mirror circuit 80) is applied to both second clamp up circuit 60 and the second clamp down circuit 70, the current sources 30 and 80 are tracked. That is, whatever process or temperature variations occur in the current source 30 or current source 80, the result affects the current that is applied to both first clamp down circuits 40 and first clamp up circuits 50, and to second clamp up circuit 60 and second clamp down circuit 70, keeping Vout stable.

What is claimed is:

1. A voltage regulating circuit for receiving an unregulated voltage, and an activation signal, said circuit comprising:

a first current mirror circuit for receiving said activation signal and for generating a first current signal in response thereto;

a first voltage clamp down circuit for receiving said unregulated voltage, said first current signal and said activation signal, and in response to said activation signal for generating a first output voltage at an output node in the event said unregulated voltage exceeds said first output voltage;

a first voltage clamp up circuit for receiving said unregulated voltage, said first current signal and an inverse of said activation signal, and in response to said inverse of said activation signal for generating a second output voltage at an output node in the event said unregulated voltage is below said second output voltage; and wherein said output node of said first voltage clamp down circuit is connected to said output node of said first clamp up circuit.

2. The voltage regulating circuit of claim 1 wherein said first clamp down circuit further comprises:

a first PMOS transistor having a first terminal and a second terminal with a channel therebetween, and a gate for controlling the flow of current therebetween, said first terminal connected to a first node, and said second terminal for receiving said unregulated voltage, said gate for receiving said first current signal;

a second PMOS transistor having a first terminal and a second terminal with a channel therebetween, and a gate for controlling the flow of current therebetween, said first terminal connected to a first node, and said second terminal for receiving said unregulated voltage, said gate for receiving said activation signal;

a third PMOS transistor having a first terminal and a second terminal with a channel therebetween, and a gate for controlling the flow of current therebetween, said first terminal connected to a ground, said second terminal connected to said output node, said gate connected to said first node; and a first NMOS transistor having a first terminal and a second terminal with a channel therebetween, and a gate for controlling the flow of current therebetween, said first terminal connected to a ground, said second terminal connected to said first node, said gate for receiving said activation signal.

3. The voltage regulating circuit of claim 2 further comprising a plurality of serially connected NMOS transistors connecting said second terminal of said first NMOS transistor to said first node.

4. The voltage regulating circuit of claim 1 wherein said first clamp up circuit further comprises:

a first PMOS transistor having a first terminal and a second terminal with a channel therebetween, and a gate for controlling the flow of current therebetween, said first terminal for receiving said unregulated voltage; said gate for receiving said first current signal;

a second PMOS transistor having a first terminal and a second terminal with a channel therebetween, and a gate for controlling the flow of current therebetween, said first terminal connected to said second terminal of said first PMOS transistor, said second terminal connected to a first node, said gate for receiving said inverse of activation signal;

a first NMOS transistor having a first terminal and a second terminal with a channel therebetween, and a gate for controlling the flow of current therebetween, said first terminal connected to said first node, said second terminal connected to a ground, and said gate for receiving said inverse of said activation signal; and a second NMOS transistor having a first terminal and a second terminal with a channel therebetween, and a gate for controlling the flow of current therebetween, said first terminal connected to said output node, said second terminal for receiving said unregulated voltage and said gate connected to said first node.

5. The voltage regulating circuit of claim 1 further comprising:

a second current mirror circuit for generating a second current signal;

a second voltage clamp down circuit for receiving said unregulated voltage and said second current signal and for generating a third output voltage at an output node in the event said unregulated voltage exceeds said third output voltage;

a second voltage clamp up circuit for receiving said unregulated voltage and said second current signal and for generating a fourth output voltage at an output node in the event said unregulated voltage is below said fourth output voltage; and wherein said output node of said second voltage clamp down circuit is connected to said output node of said second clamp up circuit, and to said output node of said first voltage clamp down circuit and to said output node of said first clamp up circuit.

6. The voltage regulating circuit of claim 5 wherein said second current signal is weaker than said first current signal.

7. The voltage regulating circuit of claim 5 wherein said second clamp down circuit further comprises:

a first PMOS transistor having a first terminal and a second terminal with a channel therebetween, and a gate for controlling the flow of current therebetween, said first terminal connected to a first node, and said second terminal for receiving said unregulated voltage, said gate for receiving said second current signal;

a second PMOS transistor having a first terminal and a second terminal with a channel therebetween, and a gate for controlling the flow of current therebetween, said first terminal connected to a first node, and said second terminal for receiving said unregulated voltage, said gate connected to said unregulated voltage;

a third PMOS transistor having a first terminal and a second terminal with a channel therebetween, and a gate for controlling the flow of current therebetween, said first terminal connected to a ground, said second terminal connected to said output node, said gate connected to said first node; and a first NMOS transistor having a first terminal and a second terminal with a channel therebetween, and a gate for controlling the flow of current therebetween, said first terminal connected to a ground, said second terminal connected to said first node, said gate for receiving said activation signal.

8. The voltage regulating circuit of claim 7 further comprising a plurality of serially connected NMOS transistors connecting said second terminal of said first NMOS transistor to said first node.

9. The voltage regulating circuit of claim 5 wherein said second clamp up circuit further comprises:

a first PMOS transistor having a first terminal and a second terminal with a channel therebetween, and a gate for controlling the flow of current therebetween, said first terminal for receiving said unregulated voltage; said gate for receiving said second current signal;

a second PMOS transistor having a first terminal and a second terminal with a channel therebetween, and a gate for controlling the flow of current therebetween, said first terminal connected to said second terminal of said first PMOS transistor, said second terminal connected to a first node, said gate connected to ground;

a first NMOS transistor having a first terminal and a second terminal with a channel therebetween, and a gate for controlling the flow of current therebetween, said first terminal connected to said first node, said second terminal connected to a ground, and said gate connected to ground; and a second NMOS transistor having a first terminal and a second terminal with a channel therebetween, and a gate for controlling the flow of current therebetween, said first terminal connected to said output node, said second terminal for receiving said unregulated voltage and said gate connected to said first node.

10. The voltage regulating circuit of claim 1 wherein said activation signal when inactive places said circuit in a standby mode, and when activated, places said circuit in an active mode.

* * * * *